US012616263B2

(12) United States Patent
Lampert

(10) Patent No.: US 12,616,263 B2
(45) Date of Patent: May 5, 2026

(54) SUPPLEMENTAL FACE FRAMING HAIR ATTACHMENT FOR CIRCULAR HAIR EXTENSIONS

(71) Applicant: Jaclynn Lampert, Lakeville, MN (US)

(72) Inventor: Jaclynn Lampert, Lakeville, MN (US)

( * ) Notice: Subject to any disclaimer, the term of this patent is extended or adjusted under 35 U.S.C. 154(b) by 0 days.

(21) Appl. No.: 18/439,727

(22) Filed: Feb. 12, 2024

(65) Prior Publication Data

US 2025/0255375 A1 Aug. 14, 2025

(51) Int. Cl.
*A41G 5/00* (2006.01)

(52) U.S. Cl.
CPC ..... *A41G 5/0046* (2013.01)

(58) Field of Classification Search
CPC ..... A41G 5/00; A41G 5/004; A41G 5/0046; A41G 5/0053; A41G 5/0073
See application file for complete search history.

(56) References Cited

U.S. PATENT DOCUMENTS

| | | | | |
|---|---|---|---|---|
| 5,551,452 | A * | 9/1996 | Barlow | A41G 5/00 132/54 |
| 11,140,934 | B2 * | 10/2021 | Jensen | A45D 8/24 |
| 2014/0238430 | A1 * | 8/2014 | Adams | A41G 5/0053 132/201 |
| 2020/0077726 | A1 * | 3/2020 | Garnett | A41G 5/008 |
| 2020/0245706 | A1 * | 8/2020 | Durand | A41G 5/0046 |

* cited by examiner

*Primary Examiner* — Rachel R Steitz
(74) *Attorney, Agent, or Firm* — Robert Brownstein

(57) ABSTRACT

The invention is a supplemental face-framing attachment that is attached to a circular hair-extension so as to provide additional hair to areas that hair-extensions omit (e.g. face framing area).

13 Claims, 12 Drawing Sheets

SUPPLEMENTAL FACE FRAMING HAIR ATTACHMENT FOR CIRCULAR HAIR EXTENSIONS

This application claims the benefit of provisional patent application No. 63/583,782, filed 2023 Sep. 19.

TECHNICAL FIELD

The present invention relates to Human Necessities/Personal or Domestic Articles, and more particularly to Hair Extensions (Wigs A41G)

BACKGROUND OF INVENTION

Many people deal with thinning hair for a variety of reasons. Commonly, hair plays an outsize role in peoples' perception of appearance. As such, hair thinning and loss can affect peoples' self-esteem leading sometimes to depression, substance abuse, and the like. Historically, many types of wigs and hair extensions have been developed to replace or supplement an individual's existing hair. Traditional wigs require a user to either cover or remove existing hair, and hair extensions often require attachment methods such as clips, glue, or ties that cause further damage to already delicate hair.

To combat damage caused by attachment methods, several circular extension devices have been proposed. Some conventional devices utilize a discrete filament base that encircles the head. When combined with natural hair these hair additions stay in place without the need for damaging glue, clips or ties. Although these devices discretely and gently add additional hair to a user's head, the design limits the amount of hair that can be added. Some users require more hair on the sides and back of the head to achieve more dramatic styles and volume.

BRIEF DESCRIPTION OF INVENTION

One embodiment of the invention is an open-ended filament to which supplemental hair is attached. Supplemental hair may be human hair or synthetic fiber strands. The filament can be tied at each end to a circular hair extension operative to fit on a user's head, under existing hair, adding a higher density of hair to an area of thinning hair, for example. In another embodiment of the invention, one or more stopper fixtures are slid onto the filament and can be moved along the filament to adjust the beginnings and ends of an attached hair portion. In another embodiment, the filament has attachment hook fixtures on each end which can be attached to the circular hair extension in lieu of tying loose ends to that structure. Another embodiment comprises a joiner fixture operative to allow separate filaments and their attached hair strands to be combined in parallel to one another, and attached in combination to the circular hair extension. This enables a blending of high and lower density supplemental hair to be comingled. By virtue of the filaments, stoppers, hooks and joiners, one is able to customize the hair density and placement before fitting the circular hair extension to one's head. This ability to customize on the fly is novel to such hair extension systems.

DETAILED DESCRIPTION OF INVENTION

The invention is an open-ended filament to which supplemental hair is attached. Supplemental hair may be human hair or synthetic fiber strands. One of more filaments can then be attached to a circular hair extension. In other implementations of such a system, the circular hair extension is custom made, and once completed, the arrangement and texture of the supplemental hair is essentially fixed. This invention allows perpetual customization.

The filament is operative to attach to a circular hair extension so that its position can be adjusted, thus making it perpetually customizable. That is, a filament with its supplemental hair strands can be repositioned to different portions of the circular head extension.

Furthermore, an embodiment of the invention permits two different filaments and their attached hair strands to be joined, parallel to one another, so that the hair strands are comingled. The combination can then also be repositioned, as needed.

Figure 1:
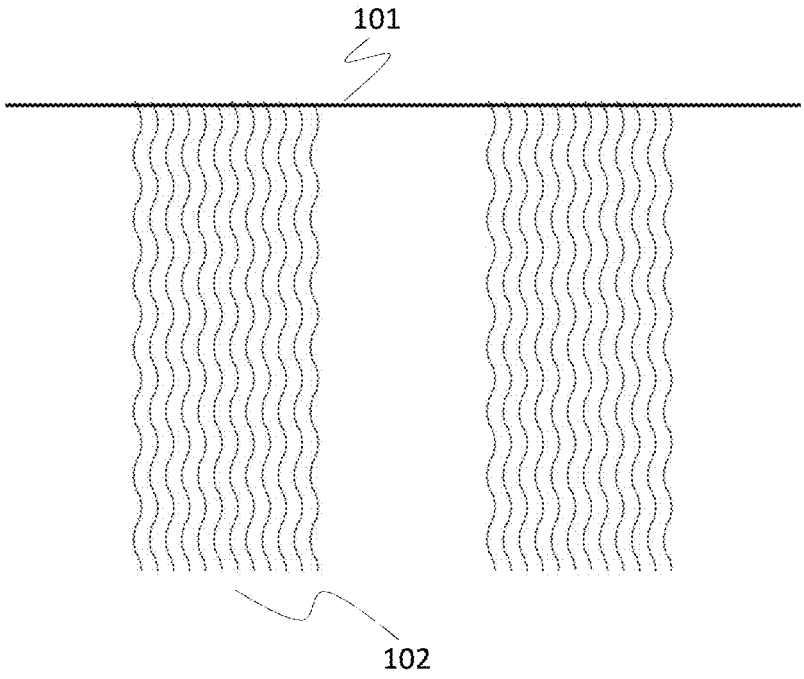
FIG. 1 shows a first embodiment of the invention.

In FIG. 1, the filament (101) has the supplemental hair strands (102) attached to it as shown. With the loose ends of the filament, it can be tied to a circular hair extension, then it can be positioned along the extension's circumference.

Figure 2:
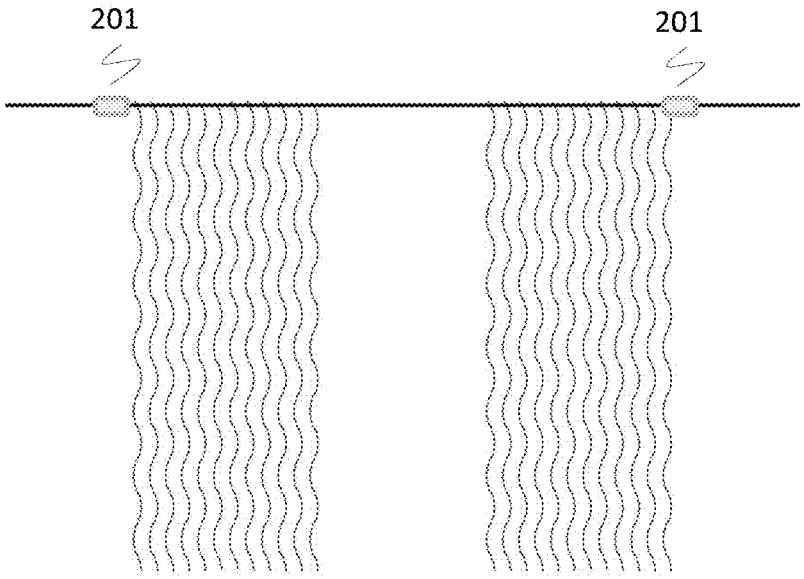
FIG. 2 shows a second embodiment of the invention.

In FIG. 2, stopper fixtures (201), permit the attached hair strands to be adjusted in beginning and end positions by sliding the stopper, akin to sliding the vertical elements of a vertical blind.

Figure 3:
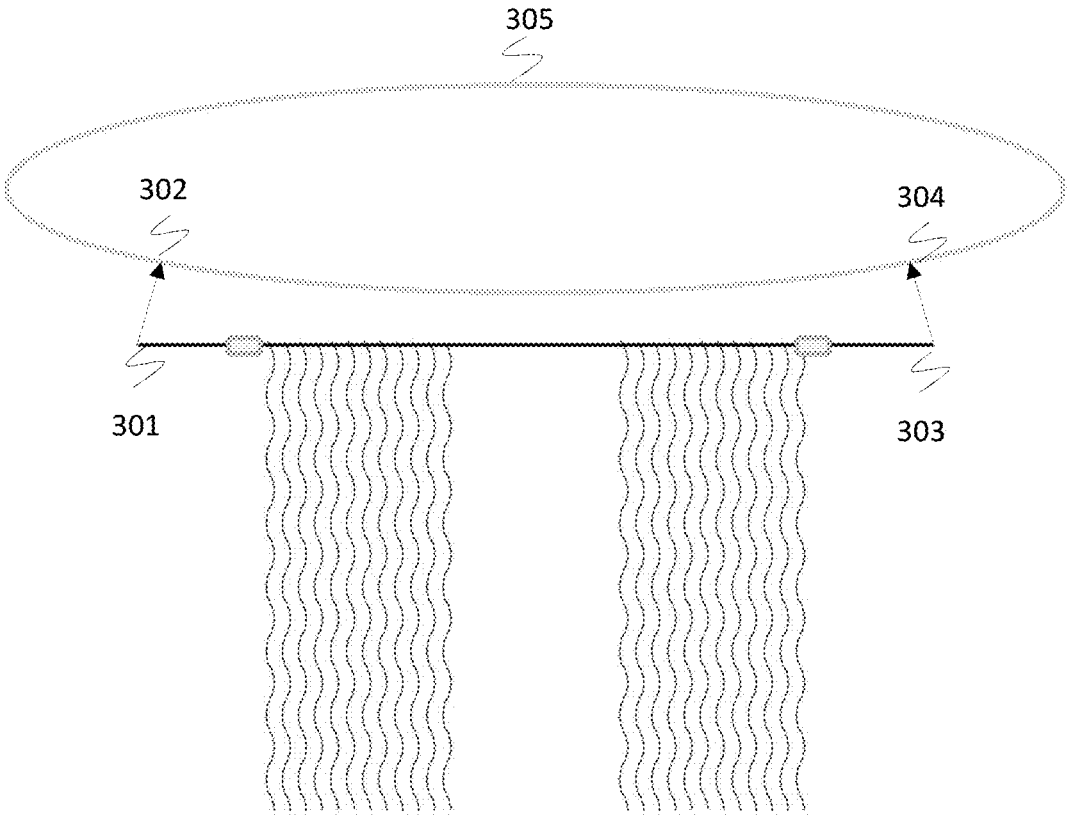
FIG. 3 shows the embodiment of FIG. 2 to be tied to a circular hair extension.

In FIG. 3, the filament of FIG. 2 is to be tied to a circular hair extension at points 302, and 304, using the filament ends 301 and 303, respectively.

Figure 4:
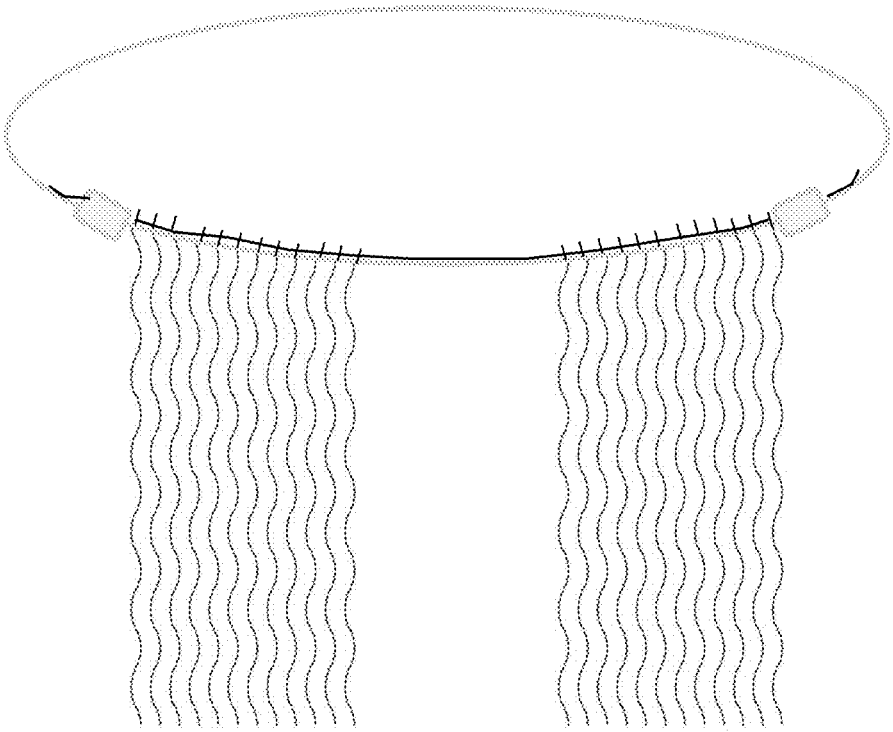
FIG. 4 shows the result of tying the embodiment of FIG. 2 to a circular hair extension.

In FIG. 4, once tied to the circular hair extension, the filament can be repositioned, and the beginning and end of the supplemental hair portion can be more compressed by using the stopper fixture.

Figure 5:
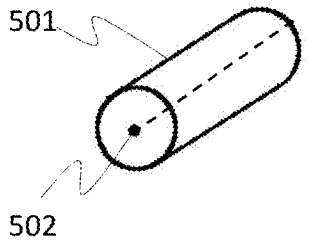
FIG. 5 shows a stopper fixture.

FIG. 5 shows the stopper fixture as a tubular structure (501) with an axial shaft (502) extending to both ends of the tube.

Figure 6:
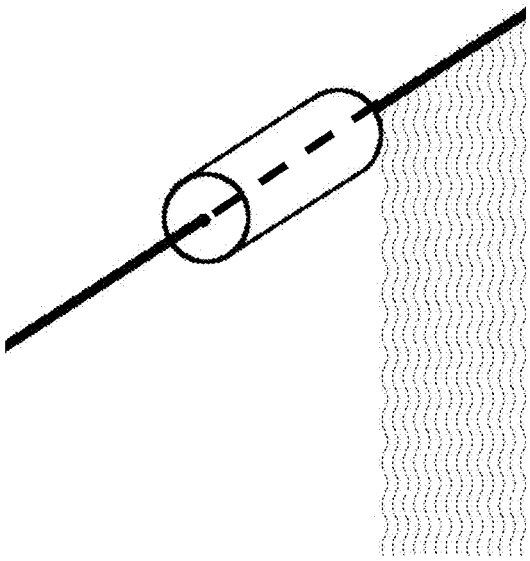
FIG. 6 shows the stopper fixture of FIG. 5 with a filament inserted through it.

FIG. 6 shows the stopper fixture of FIG. 5 with a filament threaded through its axial shaft.

Figure 7:
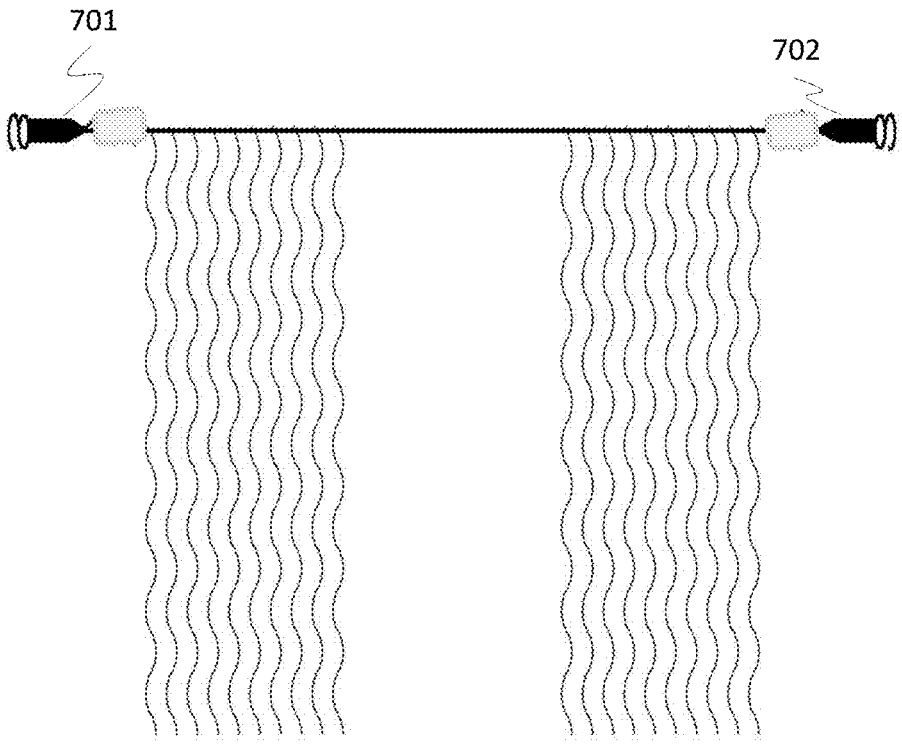
FIG. 7 shows a third embodiment of the invention.

FIG. 7 shows a second embodiment of the invention where instead of loose ends, the filament's ends are terminated in two hook fixtures (701 and 702).

Figure 8:
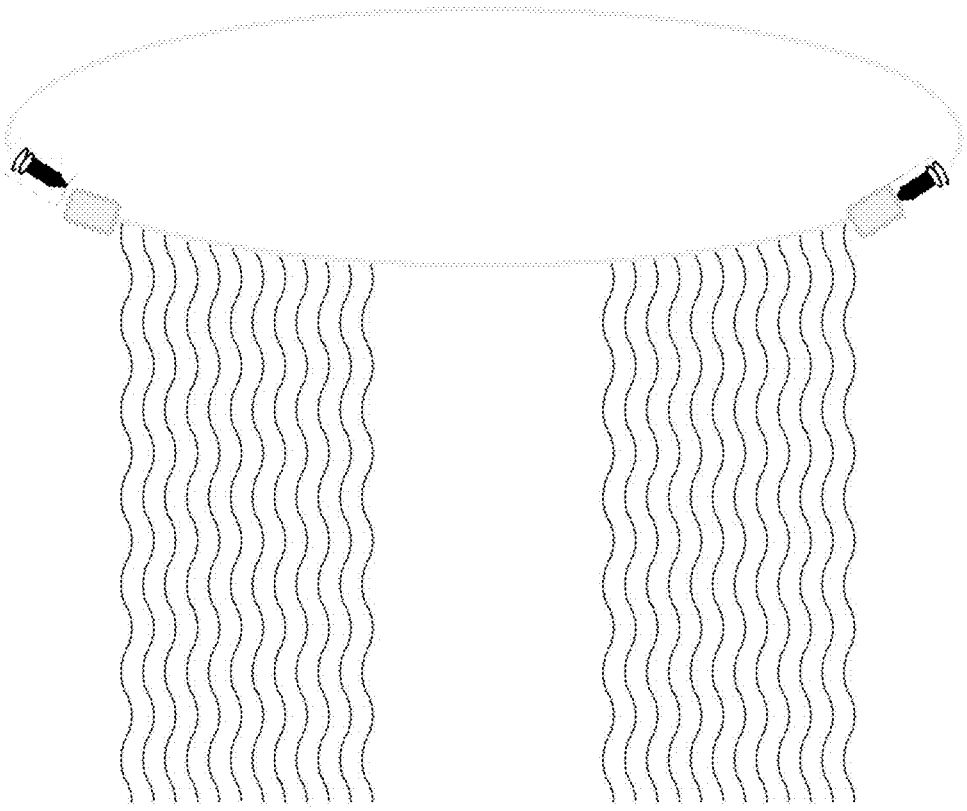
FIG. 8 shows the embodiment of FIG. 7 attached to a circular hair extension.

FIG. 8 shows the embodiment of FIG. 7 attached to a circular hair extension.

Figure 9:
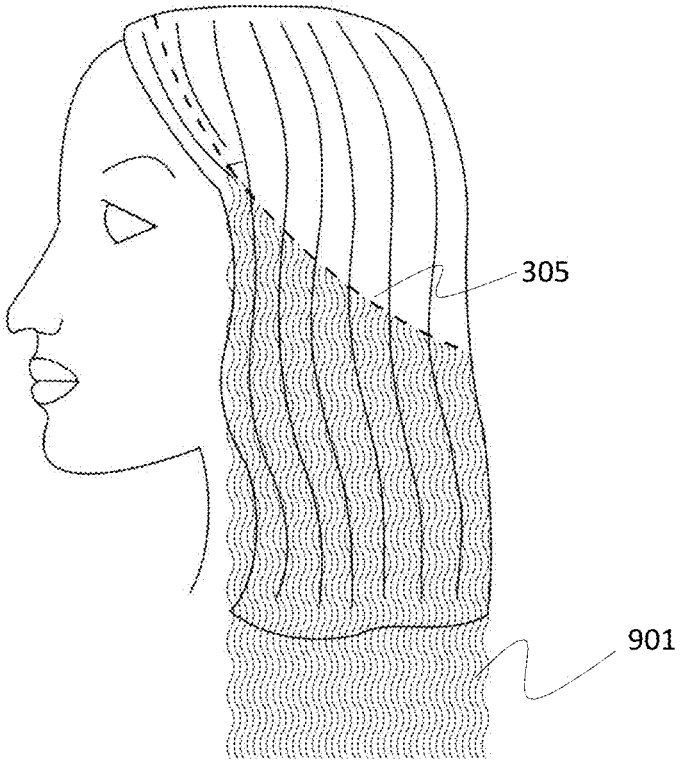
FIG. 9 shows an exemplary view of a circular hair extension, attached to an embodiment of the invention, and in place on a user's head.

In FIG. 9, a circular hair extension (305) with a filament attached to it, adds supplemental hair (901) to the user's head. Note that the circular hair extension is put in place then the existing hair is positioned to cover it, hence, the dotted line.

Figure 10:
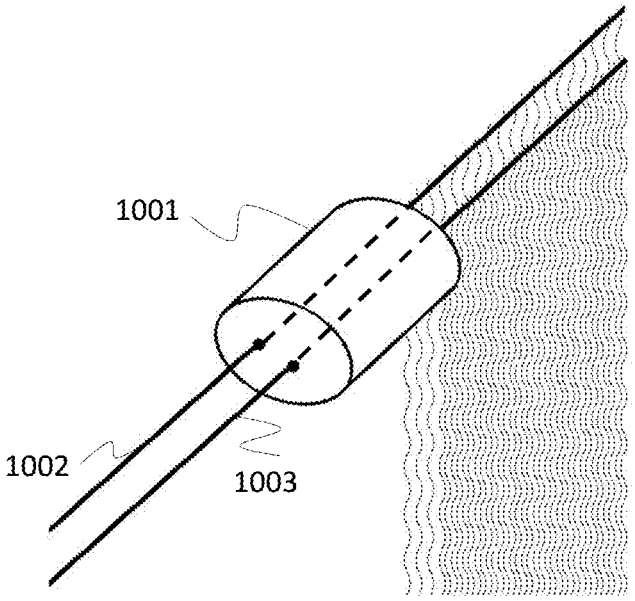
FIG. 10 shows another embodiment of the invention including a joiner fixture.

In FIG. 10, a joiner fixture (1001) is shown joining two separate filaments (1001 and 1003).

Figure 11:
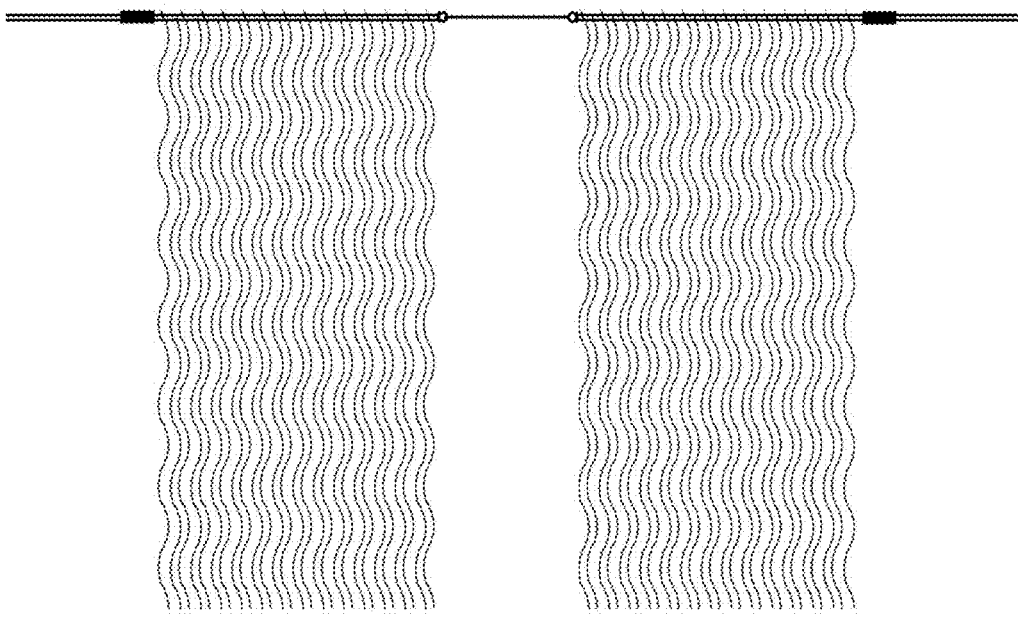
FIG. 11 shows two filaments, with the attached hair comingled, by using the joiner fixture.

FIG. 11 shows the resulting combination of filaments where the hair strands (of each) are essentially comingled.

Figure 12:
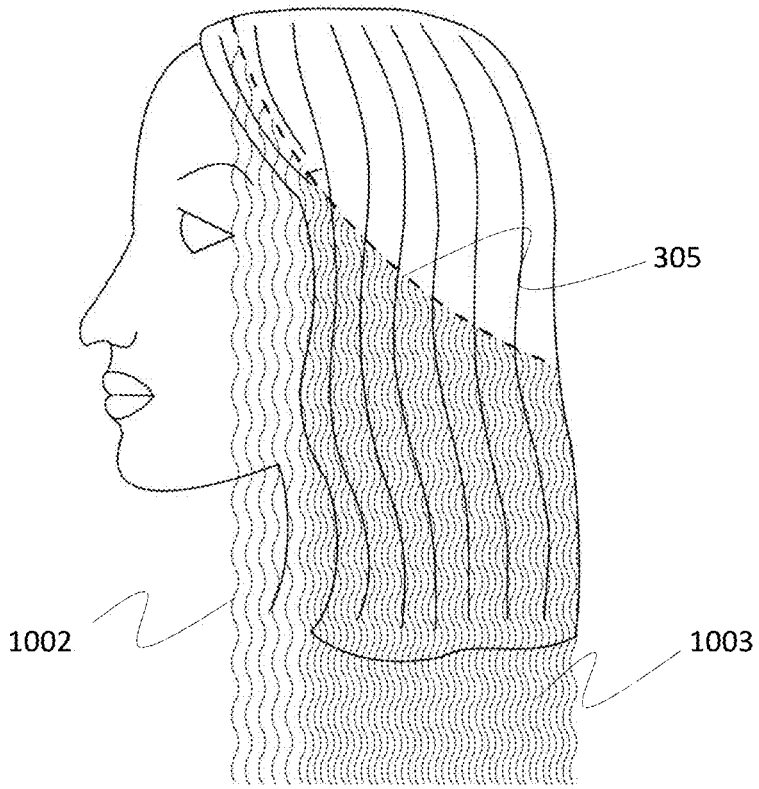
FIG. 12 shows the two-filament/circular hair extension of FIG. 11 in an exemplary view.

FIG. 12 shows the embodiment of FIG. 11. A circular hair extension has the joined filaments attached to it. The low density hair strands of filament are essentially comingled with the higher density hair strands of filament.

In all embodiments, the filament is flexible and may be opaque, translucent or transparent. Additionally, it may be colorless or colored with no limitation as to color. The filament length may vary. The width of the filaments may vary within a range of 0.1 mm to 0.5 mm.

The stopper fixture is flexible and may be opaque, translucent or transparent. The width of a stopper fixture may vary within a range of 1 mm and 3 mm.

The joiner fixture is flexible and may be opaque, translucent or transparent. The width of the joiner fixtures vary within a range of 1 mm to 5 mm.

What is claimed is:

1. A supplemental face-framing hair attachment for circular hair extensions consisting of:

a flexible filament having two ends;

a plurality of supplemental hair strands affixed along a length of the filament; and at least one stopper fixture slidably disposed on the filament and configured to delimit at least one of a beginning or an end of a region along the filament to which the supplemental hair strands are affixed wherein each of the two ends of the filament includes a hook attachment fixture configured to selectively couple the filament to a circular hair extension without tying.

2. The system as in claim 1 wherein:

the filament has loose ends; and the plurality of supplemental hair strands are affixed to the filament.

3. The system as in claim 1 wherein:

the at least one stopper fixture is comprises a tubular shaped, flexible, solid body having a single axial shaft extending from one end of the body to an opposite end, the filament being routed through the axial shaft.

4. The system as in claim 1 wherein:

the filament has a width in the range of 0.1 to 0.5 mm.

5. The system as in claim 1 wherein:

the plurality of supplemental hair strands comprise mixed lengths and colors to blend with a wearer's natural hair.

6. The system as in claim 1 wherein:

the stopper fixture has a width in the range of 1.0 to 3.0 mm.

7. A system consisting of:

a first flexible filament having two ends and a first plurality of supplemental hair strands affixed along a first length of the first filament;

at least one stopper fixture slidably disposed on the first filament and configured to delimit at least one of a beginning or an end of the first length;

a second flexible filament having a second plurality of supplemental hair strands affixed along a second length of the second filament; and at least one joiner fixture configured to hold the first and second filaments in parallel so that the first and second pluralities of supplemental hair strands are comingled along a common region while allowing repositioning of the filaments relative to a circular hair extension.

8. The system as in claim 7 wherein:

the first filament has loose ends; and the plurality of supplemental hair strands are affixed to the first filament.

9. The system as in claim 7 wherein:

the at least one stopper comprises a tubular, flexible, solid body having a single axial shaft extending from one end of the body to an opposite end, the first filament being routed through the axial shaft.

10. The system as in claim 7 wherein:

each of the two ends of the first filament comprises a hook attachment fixture configured to selectively couple the first filament to a circular hair extension without tying.

11. The system as in claim 7 wherein:

the at least one joiner fixture comprises a tubular, flexible, solid body having two, parallel, axial shafts extending from one end of the body to an opposite end, the first filament being routed through a first of the axial shafts and the second filament being routed through a second of the axial shafts so as to maintain the filaments in parallel.

12. The system as in claim 7 wherein:

the joiner fixture comprises a frictional interior surface that resists unintended sliding during wear while permitting manual adjustment.

13. The system as in claim 7 wherein:

the joiner fixture has a width of 1.0 to 5.0 mm.

* * * * *